US007988377B2

(12) United States Patent
Zhang

(10) Patent No.: US 7,988,377 B2
(45) Date of Patent: Aug. 2, 2011

(54) LOTION DISPENSER WITH TWO COMPARTMENTS

(75) Inventor: Jun Zhang, Sijhih (TW)

(73) Assignee: Chuen Chern Co. Ltd, Taipei County (TW)

( * ) Notice: Subject to any disclaimer, the term of this patent is extended or adjusted under 35 U.S.C. 154(b) by 542 days.

(21) Appl. No.: 12/186,571

(22) Filed: Aug. 6, 2008

(65) Prior Publication Data

US 2010/0034574 A1 Feb. 11, 2010

(51) Int. Cl.
*B43M 11/06* (2006.01)

(52) U.S. Cl. ..... 401/186; 401/44

(58) Field of Classification Search ..... 401/186, 401/169, 107, 99, 44, 47
See application file for complete search history.

(56) References Cited

U.S. PATENT DOCUMENTS 7,377,711 B2 * 5/2008 Byun ..... 401/269

* cited by examiner

*Primary Examiner* — Huyen Le

(57) ABSTRACT

A dispensing device includes inner and outer compartments for housing two different cosmetic liquid materials therein, the outer compartment secured to a cap by threading; a spring biased valve for blocking both openings of the inner and outer compartments when the device is in an inoperative position; and an outlet assembly partially fastened in the valve. An individual may unfasten and remove the cap from the device to unblock the valve, and squeeze both the outer and the inner compartments to push the cosmetic liquid materials to mix in the outlet assembly prior to dispensing out of the device.

10 Claims, 11 Drawing Sheets

LOTION DISPENSER WITH TWO COMPARTMENTS

BACKGROUND OF THE INVENTION

1. Field of Invention

The invention relates to dispenser for containing lotion or cosmetic cream and more particularly to such a dispenser having a first compartment for housing one cosmetic liquid material and a second compartment for housing a different cosmetic liquid material, the two different cosmetic liquid materials are intended to keep isolated until dispensed.

2. Description of Related Art

A conventional dispenser for housing cosmetic liquid materials (i.e., called lotion dispenser hereinafter) is shown in FIGS. 10 and 11. The dispenser comprises an inner compartment 70 for housing one cosmetic liquid material (e.g., lotion, cosmetic cream, or the like), an outer compartment 80 with the inner compartment 70 disposed therein for housing a different cosmetic liquid material (e.g., lotion, cosmetic cream, or the like), an opening 90 at one ends of the compartments 70, 80, and a cap (not shown) for covering the opening 90.

However, the well known lotion dispenser suffers from a number of disadvantages. For example, cosmetic liquid material in the outer compartment 80 may leak out of the cap from the opening 90 when a user screws the cap. Further, the accidentally dispensed cosmetic liquid materials may dry to block the opening 90 if not being removed in time. This is not desired. Moreover, dispensed cosmetic liquid materials may adhere to, for example, a cosmetic brush, disposed in the cap. And in turn, the brush may be stuck and thus becomes useless. Furthermore, the sealing of the dispenser by the cap is not reliable and thus cosmetic liquid materials contained therein may become dry or deteriorate in quality. Thus, the need for improvement still exists.

SUMMARY OF THE INVENTION

It is therefore one object of the invention to provide a device for dispensing a cosmetic liquid preparation, comprising a collapsible tubular inner compartment for housing a first cosmetic liquid material therein and comprising an axial projecting first opening at one end; a collapsible tubular outer compartment for housing a second cosmetic liquid material therein, the second cosmetic liquid material being different from the first cosmetic liquid material, and the inner compartment being disposed in the outer compartment, the outer compartment comprising an axial projecting second opening at one end with the first opening disposed therein, and a mating member around the second opening; a valve assembly comprising a passageway having a rear radial tunnel, the passageway being fitted in the second opening, a spring biased hollow plunger having a forward annular flange and a rear projection adapted to slide in the passageway and block the tunnel when the device is in an inoperative position; and a dividing member disposed in the rear projection and comprising an inner channel, an outer channel, and a block disposed in the first opening for blocking the first opening in the inoperative position; an outlet assembly having a rear portion fixedly fastened in the bore of the plunger; and a cap comprising an internal receiving space and a corresponding mating member adapted to secure to the mating member for covering both the outlet assembly and the valve assembly and fastening the flange; whereby for dispensing the cosmetic liquid preparation, an individual unfastens and removes the cap from the device to unfasten the flange such that the plunger is pushed forward to clear the tunnel to permit the second cosmetic liquid material to be in fluid communication with the outer channel through the tunnel, and cause the block to clear the first opening to permit the first cosmetic liquid material to be in fluid communication with the inner channel through the first opening and the block and such that squeezing both the outer and the inner compartments will push both the first and the second cosmetic liquid materials to mix in the outlet assembly prior to dispensing out of the device; and whereby for closing the device after use, the individual secures the cap back onto the device to push both the outlet assembly and the valve assembly back to the inoperative position with the tunnel being blocked by the rear projection and the first opening being blocked by the block respectively.

The above and other objects, features and advantages of the invention will become apparent from the following detailed description taken with the accompanying drawings.

DETAILED DESCRIPTION OF THE INVENTION

Figure 1:
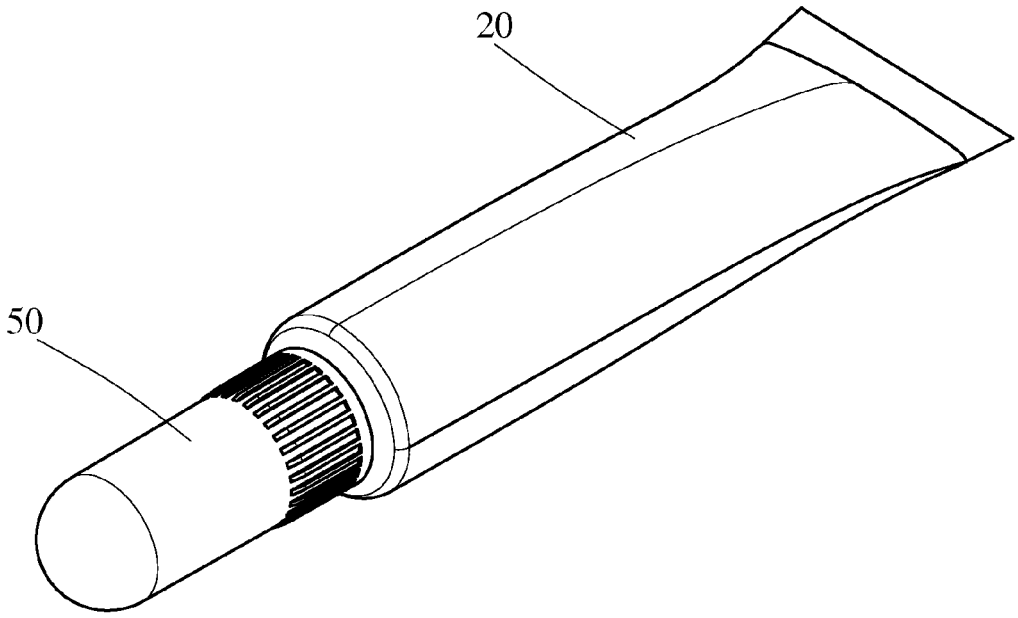
FIG. 1 is a perspective view of a first preferred embodiment of lotion dispenser according to the invention.
Figure 2:
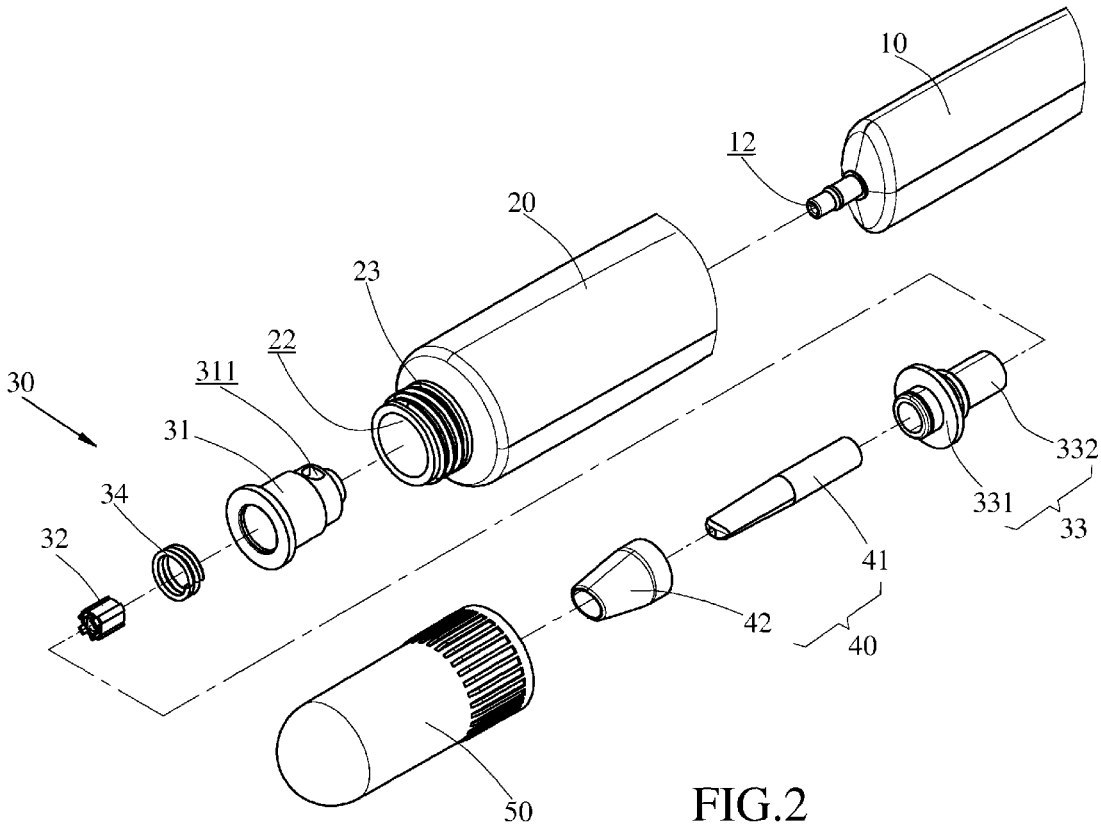
FIG. 2 is an exploded of the lotion dispenser of FIG. 1.

Referring to FIGS. 1 to 4, a lotion dispenser in accordance with a first preferred embodiment of the invention comprises an inner compartment 10, an outer compartment 20, a valve assembly 30, an outlet assembly 40, and a cap 50. It is note that in addition to lotion the lotion dispenser is adapted to house other cosmetic liquid materials such as creams or the like therein.

Both the inner and outer compartments 10, 20 are collapsible tubular members. The inner compartment 10 houses a first cosmetic liquid material 11 therein and comprises a projecting first opening 12 at one end. The outer compartment 20 houses a second cosmetic liquid material 21 different from the first cosmetic liquid material 11 therein with the inner compartment 10 disposed therein. The outer compartment 20 comprises a projecting second opening 22 at one end with the first opening 12 disposed therein. Outer threads 23 are formed around the second opening 22.

The valve assembly 30 comprises a stepped-diameter passageway 31 having a rear radial tunnel 311, the passageway 31 being fitted in the second opening 22; a hollow plunger 33 having a forward annular flange 331 and a rear projection 332 adapted to slide in the passageway 31 and block the tunnel 311 when the lotion dispenser is in an inoperative position (see FIG. 3); a dividing member 32 disposed in the rear projection 332 and comprising an inner channel, an outer channel, and a conic block 323 disposed in the first opening 12 for blocking same in the inoperative position; and a helical spring 34 put on the rear projection 332 contained in the passageway 31 with both ends urged against the passageway 31 and an intermediate annular flange (not numbered) of the plunger 33 (i.e., the spring 34 being compressed when the lotion dispenser is closed).

The outlet assembly 40 has a rear portion fixedly fastened in the bore of the plunger 33 proximate the flange 331. The outlet assembly 40 comprises a hollow cylindrical outlet member 41 and a conic sleeve 42 having a rear portion secured onto the head of the plunger 33 engaged with the flange 331, and a front portion secured onto the hollow cylindrical outlet member 41. That is, both the valve assembly 30 and the outlet assembly 40 are secured together.

The cap 50 is of cup shaped and comprises an internal receiving space 51 and an internally threaded section 52 at the rear end. The internally threaded section 52 is adapted to secure to the outer threads 23 for covering both the outlet assembly 40 and the valve assembly 30 and fastening the flange 331 (i.e., the closed position of the lotion dispenser as shown in FIG. 3).

Figure 4:
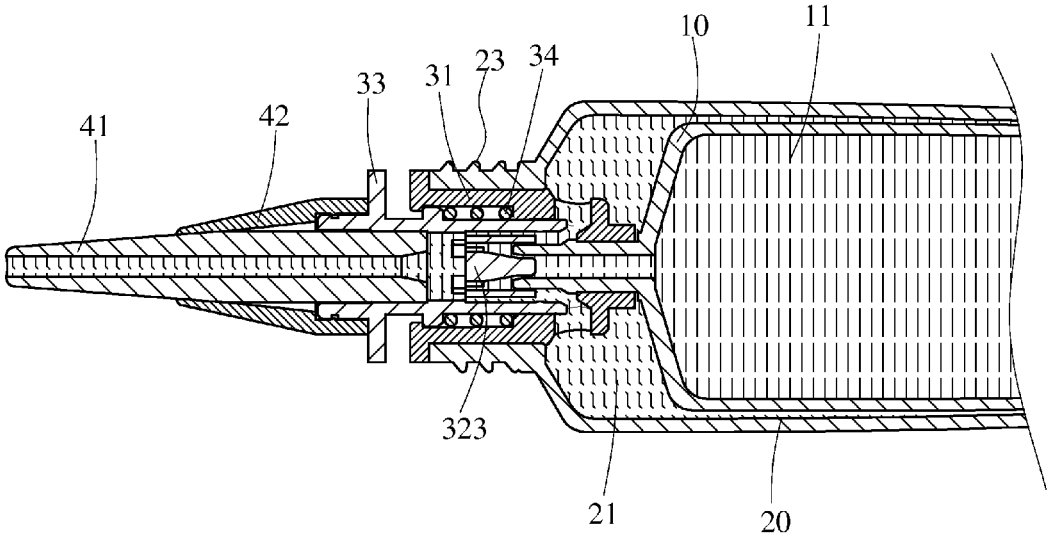
FIG. 4 is a view similar to FIG. 3 where the cap is removed from the lotion dispenser.

In use as shown in FIG. 4, an individual may first unscrew the cap 50 and remove same from the lotion dispenser. The flange 331 is thus not fastened by the cap 50. And in turn, the plunger 33 is immediately pushed forward by the expanding spring 34 because the energized spring 34 is no more blocked by the flange 331. Also, the tunnel 311 is not blocked by the rear projection 332. Hence, the second cosmetic liquid material 21 is in fluid communication with the outer channel of the dividing member 32 through the tunnel 311. Also, the first opening 12 is not blocked by the conic block 32. Hence, the first cosmetic liquid material 11 is in fluid communication with the inner channel of the dividing member 32 through the first opening 12 and the conic block 323. Next, the individual may squeeze the outer compartment 20 and thus the inner compartment 10. As an end, both the first and second cosmetic liquid materials 11, 21 are pushed to mix in the hollow cylindrical outlet member 41 prior to dispensing out of the lotion dispenser.

Figure 3:
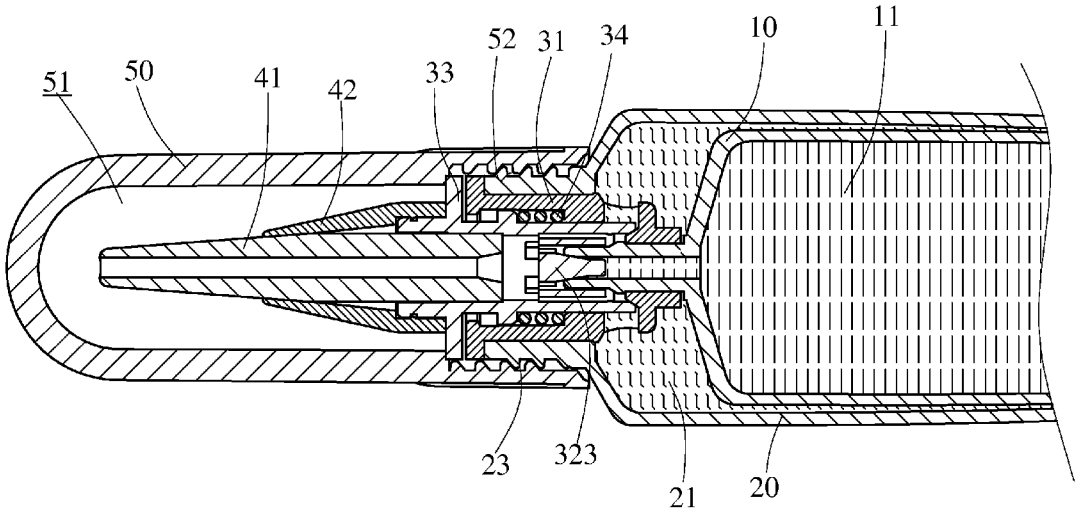
FIG. 3 is a fragmentary longitudinal sectional view of the lotion dispenser of FIG. 2 where the cap is screwed onto the lotion dispenser.

After use, the individual may screw the cap 50 back onto the outer threads 23 with the outlet assembly 40 and the valve assembly 30 pushed back to its inoperative position as shown in FIG. 3. At this position, the tunnel 311 is blocked by the rear projection 332 and the first opening 12 is blocked by the conic block 323 respectively. Hence, the lotion dispenser is fully closed and any leaking is not under consideration.

It is envisaged by the invention that two different cosmetic liquid materials can be kept isolated in two compartments of a lotion dispenser until dispensed for use.

Figure 5:
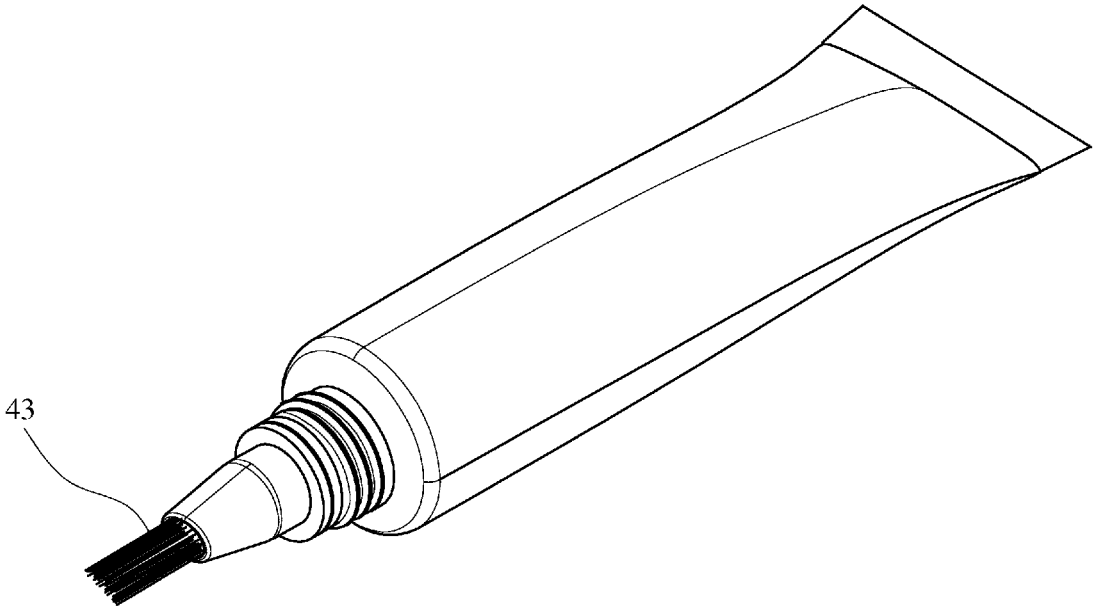
FIG. 5 is a perspective view of a second preferred embodiment of lotion dispenser according to the invention.

Referring to FIG. 5, it shows a second preferred embodiment of lotion dispenser according to the invention. In this embodiment, the hollow cylindrical outlet member 41 is replaced by a brush 43.

Figure 6:
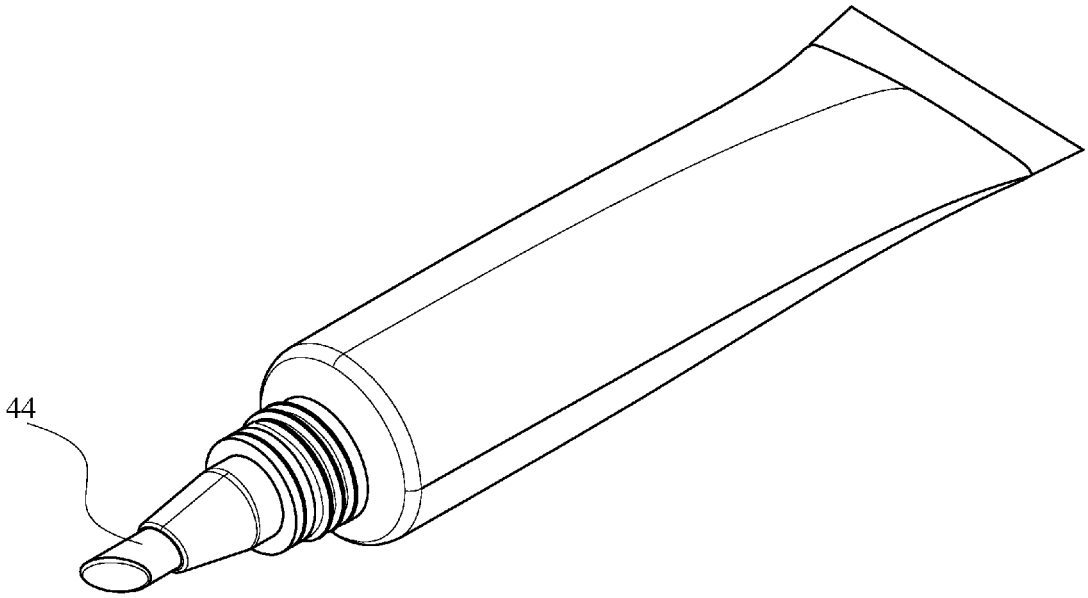
FIG. 6 is a perspective view of a third preferred embodiment of lotion dispenser according to the invention.

Referring to FIG. 6, it shows a third preferred embodiment of lotion dispenser according to the invention. In this embodiment, the hollow cylindrical outlet member 41 is replaced by a cylindrical member with an obliquely truncated head.

Figure 7:
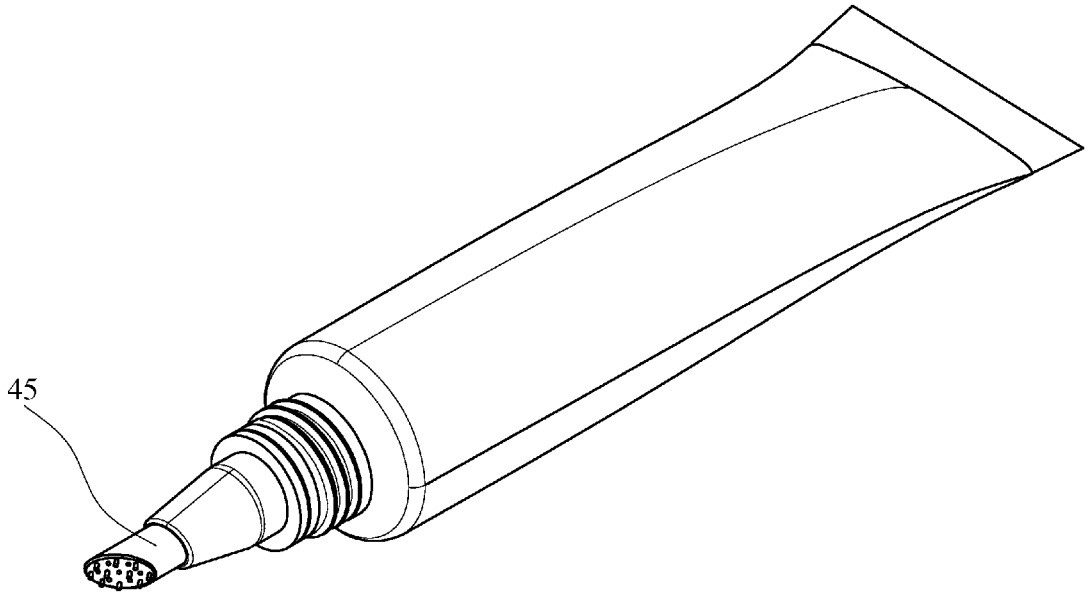
FIG. 7 is a perspective view of a fourth preferred embodiment of lotion dispenser according to the invention.

Referring to FIG. 7, it shows a fourth preferred embodiment of lotion dispenser according to the invention. In this embodiment, the hollow cylindrical outlet member 41 is replaced by a cylindrical member 45 full of apertures.

Figure 8:
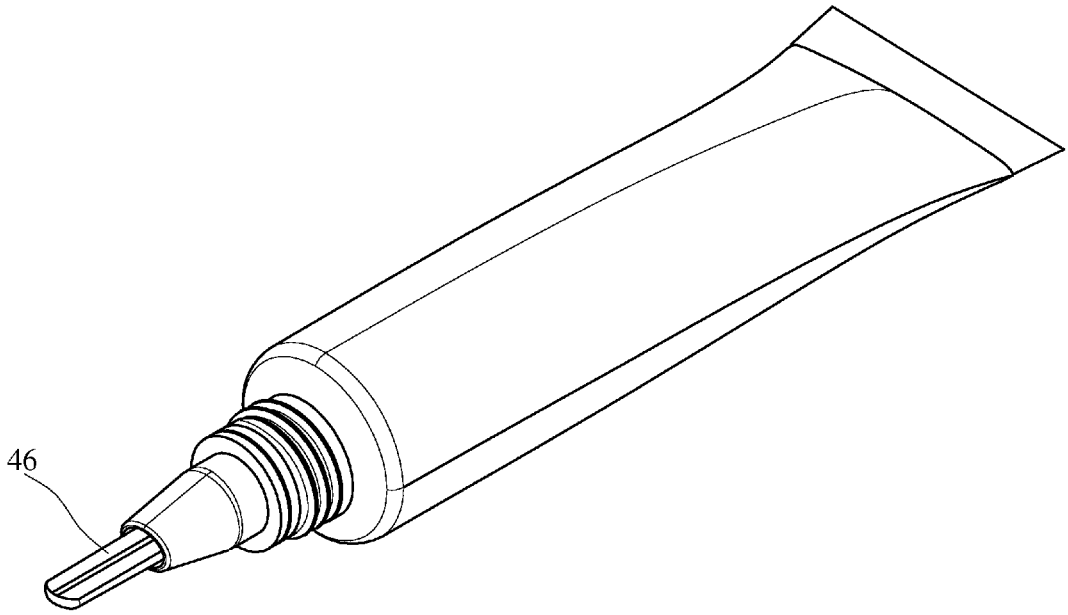
FIG. 8 is a perspective view of a fifth preferred embodiment of lotion dispenser according to the invention.

Referring to FIG. 8, it shows a fifth preferred embodiment of lotion dispenser according to the invention. In this embodiment, the hollow cylindrical outlet member 41 is replaced by a plate member 46 made of silicone.

Figure 9:
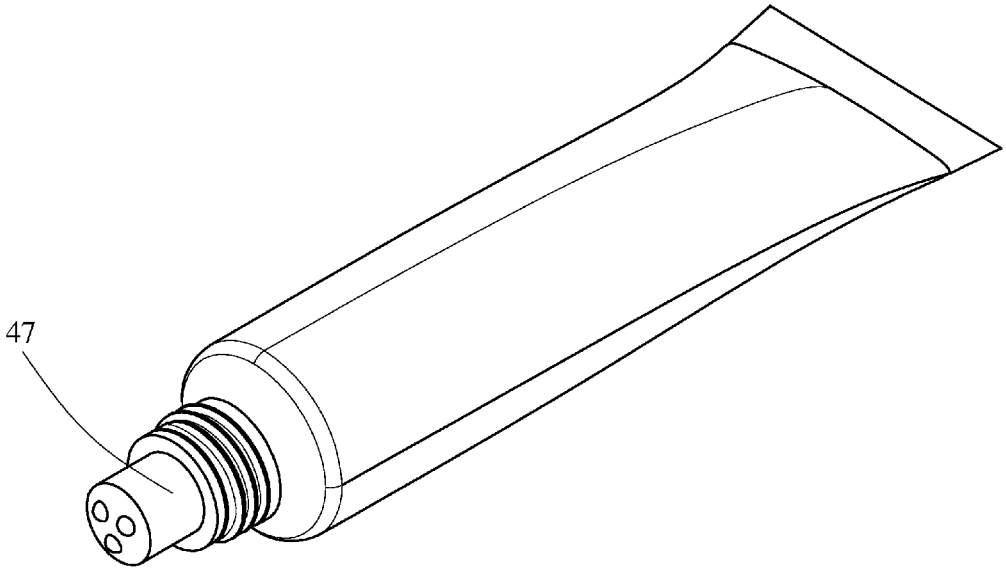
FIG. 9 is a perspective view of a sixth preferred embodiment of lotion dispenser according to the invention.
Figure 10:
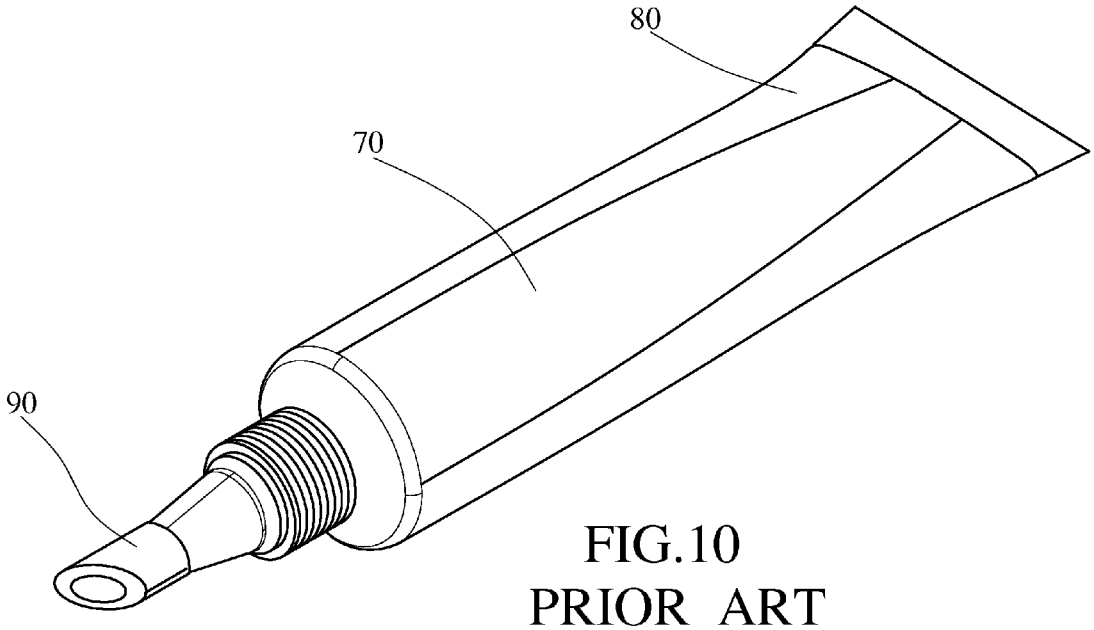
FIG.10 PRIOR ART
FIG. 10 is a perspective view of a conventional lotion dispenser.
Figure 11:
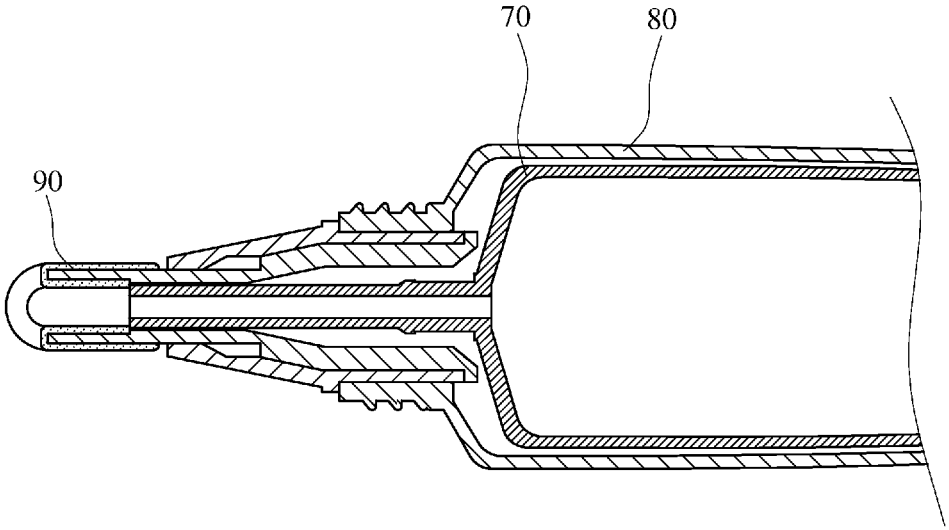
FIG.11 PRIOR ART
FIG. 11 is a fragmentary longitudinal sectional view of the lotion dispenser of FIG. 10.

Referring to FIG. 9, it shows a sixth preferred embodiment of lotion dispenser according to the invention. In this embodiment, the hollow cylindrical outlet member 41 is replaced by a cylindrical member 47 having three rollers.

While the invention herein disclosed has been described by means of specific embodiments, numerous modifications and variations could be made thereto by those skilled in the art without departing from the scope and spirit of the invention set forth in the claims.

What is claimed is:

1. A device for dispensing a cosmetic liquid preparation, comprising:

a collapsible tubular inner compartment for housing a first cosmetic liquid material therein and comprising an axial projecting first opening at one end;

a collapsible tubular outer compartment for housing a second cosmetic liquid material therein, the second cosmetic liquid material being different from the first cosmetic liquid material, and the inner compartment being disposed in the outer compartment, the outer compartment comprising an axial projecting second opening at one end with the first opening disposed therein, and a mating member around the second opening;

a valve assembly comprising a passageway having a rear radial tunnel, the passageway being fitted in the second opening, a spring biased hollow plunger having a forward annular flange and a rear projection adapted to slide in the passageway and block the tunnel when the device is in an inoperative position; and a dividing member disposed in the rear projection and comprising an inner channel, an outer channel, and a block disposed in the first opening for blocking the first opening in the inoperative position;

an outlet assembly having a rear portion fixedly fastened in the bore of the plunger; and a cap comprising an internal receiving space and a corresponding mating member adapted to secure to the mating member for covering both the outlet assembly and the valve assembly and fastening the flange;

whereby for dispensing the cosmetic liquid preparation, an individual unfastens and removes the cap from the device to unfasten the flange such that the plunger is pushed forward to clear the tunnel to permit the second cosmetic liquid material to be in fluid communication with the outer channel through the tunnel, and cause the block to clear the first opening to permit the first cosmetic liquid material to be in fluid communication with the inner channel through the first opening and the block and such that squeezing both the outer and the inner compartments will push both the first and the second cosmetic liquid materials to mix in the outlet assembly prior to dispensing out of the device; and whereby for closing the device after use, the individual secures the cap back onto the device to push both the outlet assembly and the valve assembly back to the inoperative position with the tunnel being blocked by the rear projection and the first opening being blocked by the block respectively.

2. The device of claim 1, further comprising a helical spring put on the rear projection contained in the passageway with both ends urged against the passageway and the plunger such that the plunger is rendered to be a spring biased member, and is compressed when the device is closed.

3. The device of claim 1, wherein the outlet assembly comprising a hollow cylindrical outlet member and a conic sleeve having a rear portion secured onto the plunger by engaging the flange, and a front portion secured onto the outlet member.

4. The device of claim 1, wherein the outlet member is a brush.

5. The device of claim 1, wherein the outlet member is a cylindrical member with an obliquely truncated head.

6. The device of claim 1, wherein the outlet member is a cylindrical member having a plurality of apertures.

7. The device of claim 1, wherein the outlet member is a plate member made of silicone.

8. The device of claim 1, wherein the outlet member is a cylindrical member having a plurality of rollers.

9. The device of claim 1, wherein the mating member is an externally threaded section, and the corresponding mating member is an internally threaded section.

10. The device of claim 1, wherein the block is conic.

* * * * *